US009308547B2

(12) United States Patent
Clark et al.

(10) Patent No.: US 9,308,547 B2
(45) Date of Patent: Apr. 12, 2016

(54) HOT MELT ADHESIVE SYSTEMS AND RELATED METHODS

(71) Applicant: Nordson Corporation, Westlake, OH (US)

(72) Inventors: Justin A. Clark, Suwanee, GA (US); William M. Ridge, Cumming, GA (US)

(73) Assignee: NORDSON CORPORATION, Westlake, OH (US)

( * ) Notice: Subject to any disclaimer, the term of this patent is extended or adjusted under 35 U.S.C. 154(b) by 0 days.

(21) Appl. No.: 14/546,387

(22) Filed: Nov. 18, 2014

(65) Prior Publication Data

US 2015/0158049 A1 Jun. 11, 2015

Related U.S. Application Data

(60) Provisional application No. 61/913,523, filed on Dec. 9, 2013.

(51) Int. Cl.

| | |
|---|---|
| ***B65G 53/58*** | (2006.01) |
| ***B05C 11/10*** | (2006.01) |
| ***B08B 9/032*** | (2006.01) |
| *B05B 7/14* | (2006.01) |

(52) U.S. Cl.

CPC ..... *B05C 11/1042* (2013.01); *B08B 9/0325* (2013.01); *B08B 9/0328* (2013.01); *B05B 7/1409* (2013.01); *Y10T 137/0419* (2015.04); *Y10T 137/4259* (2015.04)

(58) Field of Classification Search

USPC ..... 406/130, 92, 96, 139, 144, 197

See application file for complete search history.

(56) References Cited

U.S. PATENT DOCUMENTS

| | | | | | |
|---|---|---|---|---|---|
| 916,578 | A * | 3/1909 | Murphy | B61D 5/004 | 406/130 |
| 1,310,815 | A * | 7/1919 | Weaver | B01D 19/0042 | 406/130 |
| 1,473,757 | A * | 11/1923 | Dorsey | 122/395 | |
| 1,755,490 | A * | 4/1930 | Seymour | B02C 11/04 | 209/137 |
| 3,270,921 | A * | 9/1966 | Nadolske | B60P 3/224 | 222/132 |
| 3,592,363 | A * | 7/1971 | Stout | C21C 7/0037 | 164/57.1 |
| 3,700,143 | A * | 10/1972 | Shaver | B61D 5/004 | 222/148 |
| 4,019,783 | A * | 4/1977 | Kayser | B65G 53/14 | 406/130 |
| 4,793,743 | A * | 12/1988 | Grodecki | A01C 7/081 | 406/123 |
| 4,846,608 | A * | 7/1989 | Sanders | B65G 53/14 | 222/82 |
| 5,791,830 | A * | 8/1998 | Fort | B28B 13/021 | 406/151 |
| 5,803,673 | A * | 9/1998 | Reinsch | B65D 88/30 | 406/106 |
| 6,089,795 | A * | 7/2000 | Booth | B60P 1/42 | 209/133 |
| 6,224,297 | B1 * | 5/2001 | McCann | B65G 53/525 | 406/105 |
| 7,300,521 | B2 * | 11/2007 | Bowman | E04F 21/12 | 118/308 |
| 2008/0205998 | A1 * | 8/2008 | Lasko | B05B 7/1404 | 406/52 |
| 2013/0115016 | A1 * | 5/2013 | Ross | B65G 51/00 | 406/127 |
| 2013/0287503 | A1 * | 10/2013 | Clark | B65G 53/10 | 406/98 |
| 2015/0063925 | A1 * | 3/2015 | Varga | B65G 53/56 | 406/1 |

* cited by examiner

*Primary Examiner* — Joseph Dillon, Jr.

(74) *Attorney, Agent, or Firm* — Baker & Hostetler LLP

(57) ABSTRACT

A hot melt adhesive system includes a supply container for storing adhesive particulate, a transfer pump operatively connected to the supply container, a transfer hose operatively coupled to the transfer pump, and a blocking member. The blocking member is movable between a first position in which stored adhesive particulate and air are permitted to be withdrawn from the supply container into the transfer hose, and a second position in which the stored adhesive particulate is blocked from passing through the transfer hose while air is permitted to pass therethrough to flush the transfer hose of residual adhesive particulate.

21 Claims, 6 Drawing Sheets

HOT MELT ADHESIVE SYSTEMS AND RELATED METHODS

CROSS-REFERENCE TO RELATED APPLICATION

This application claims the benefit of U.S. Provisional Application Ser. No. 61/913,523, filed Dec. 9, 2013, the disclosure of which is hereby incorporated by reference herein.

TECHNICAL FIELD

The present invention relates generally to hot melt adhesive systems. More particularly, the invention relates to systems and methods for transferring hot melt adhesive particulate from a supply container to an adhesive melter.

BACKGROUND

Thermoplastic adhesives, otherwise known as "hot melt" adhesives, have been widely used in industry for various applications. For example, thermoplastic hot melt adhesives are used for carton sealing, case sealing, tray forming, pallet stabilization, nonwoven application including diaper manufacturing, and many other applications. Hot melt adhesive, in its pre-melted state (referred to herein as "particulate" hot melt adhesive), can be provided in a variety of particulate shapes and sizes, ranging from small bb-sized pieces, to larger sized pieces including pellets and chips. Adhesive material, in the form of adhesive particulate, may be stored in an adhesive supply container and transferred to an adhesive melter, as part of an automated filling operation. At the adhesive melter, the adhesive material is then heated and melted to a desired temperature for dispensing. Hot melt adhesives are often dispensed by systems including a dispensing gun coupled via heated hoses to an adhesive melter.

In an automatic fill system, a transfer pump, such as a pneumatic pump, is connected to the adhesive container for transferring the adhesive particulate from the supply container, through a transfer hose, and to the adhesive melter. Pneumatic pumps generally rely on the suction of air located within gaps between individual pieces of adhesive particulate stored within the supply container or air otherwise disposed within the supply container. Traditionally, the adhesive particulate is fed by gravity into a lower portion of the supply container toward an inlet of the transfer pump and covers a majority of the pump inlet. At the start of a traditional fill cycle, the transfer pump generates a vacuum at the pump inlet that withdraws the adhesive particulate and air from the adhesive container. The withdrawn air and adhesive particulate then pass through the transfer hose toward the adhesive melter. In turn, the suction of the air creates a vacuum within the gaps of the adhesive particulate that withdraws additional air from a surrounding environment. The additional air from the surrounding environment continuously replaces the air within the supply container for transferring the adhesive particulate through the transfer pump.

At the end of the traditional fill cycle, the transfer pump is switched off in order to cease the transfer of air and thereby cease the transfer of adhesive particulate. Consequently, adhesive particulate that has already been withdrawn from the supply container into the transfer hose but not yet fully transferred to the adhesive melter collects and is left stranded at various low points and horizontal points within the transfer hose, unable to overcome gravitational forces. These collections of residual adhesive particulate remain within the transfer hose and are later flushed from the hose only by passing additional air through the system at the start of the next fill cycle. This characteristic limits the useful vertical transfer capability of a traditional fill system. In this regard, if a vertical section of the hose is too long, the pressure-limited pump may not be able to lift or push the particulate adhesive material through the vertical hose section during the subsequent fill cycle. Furthermore, some of the horizontal and low points at which stranded adhesive collect are located near heated components. The heat generated by these components may partially or fully melt the stranded adhesive, and lead to adhesive build-up and clogging of the transfer hose. These consequences of stranded adhesive increase the demands on transfer system components, such as the transfer pump, and reduce overall system efficiency.

There is a need, therefore, for an adhesive system and method of use that addresses the present challenges and characteristics such as those discussed above.

SUMMARY

An exemplary embodiment of a hot melt adhesive system includes a supply container for storing adhesive particulate, a transfer pump operatively connected to the supply container, a transfer hose coupled to the transfer pump, and a blocking member. The transfer pump includes a pump inlet and a pump outlet, and is operable to generate a vacuum at the pump inlet to withdraw the stored adhesive particulate and air from the supply container. The transfer hose is operatively coupled to the pump outlet for transferring the withdrawn adhesive particulate toward an adhesive melter. The blocking member is movable between a first position and a second position. In the first position, the stored adhesive particulate and air are permitted to be withdrawn from the supply container into the transfer hose. In the second position, the stored adhesive particulate is blocked from passing through the transfer hose while air is permitted to pass through the transfer hose toward the adhesive melter, thereby flushing the transfer hose of residual adhesive particulate.

In use, a method of transferring hot melt adhesive particulate includes storing adhesive particulate in a supply container and placing a blocking member in a first position in which the stored adhesive particulate and air are permitted to be withdrawn from the supply container into a transfer hose. The method further includes powering a transfer pump to generate a vacuum at a pump inlet to withdraw the stored adhesive particulate and air from the supply container into the transfer hose, and transferring the withdrawn adhesive particulate through the transfer hose toward an adhesive melter. Additionally, the method further includes moving the blocking member to a second position in which the stored adhesive particulate is blocked from passing through the transfer hose. Finally, the method includes withdrawing additional air from the supply container past the blocking member in the second position to flush the transfer hose of residual adhesive particulate.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
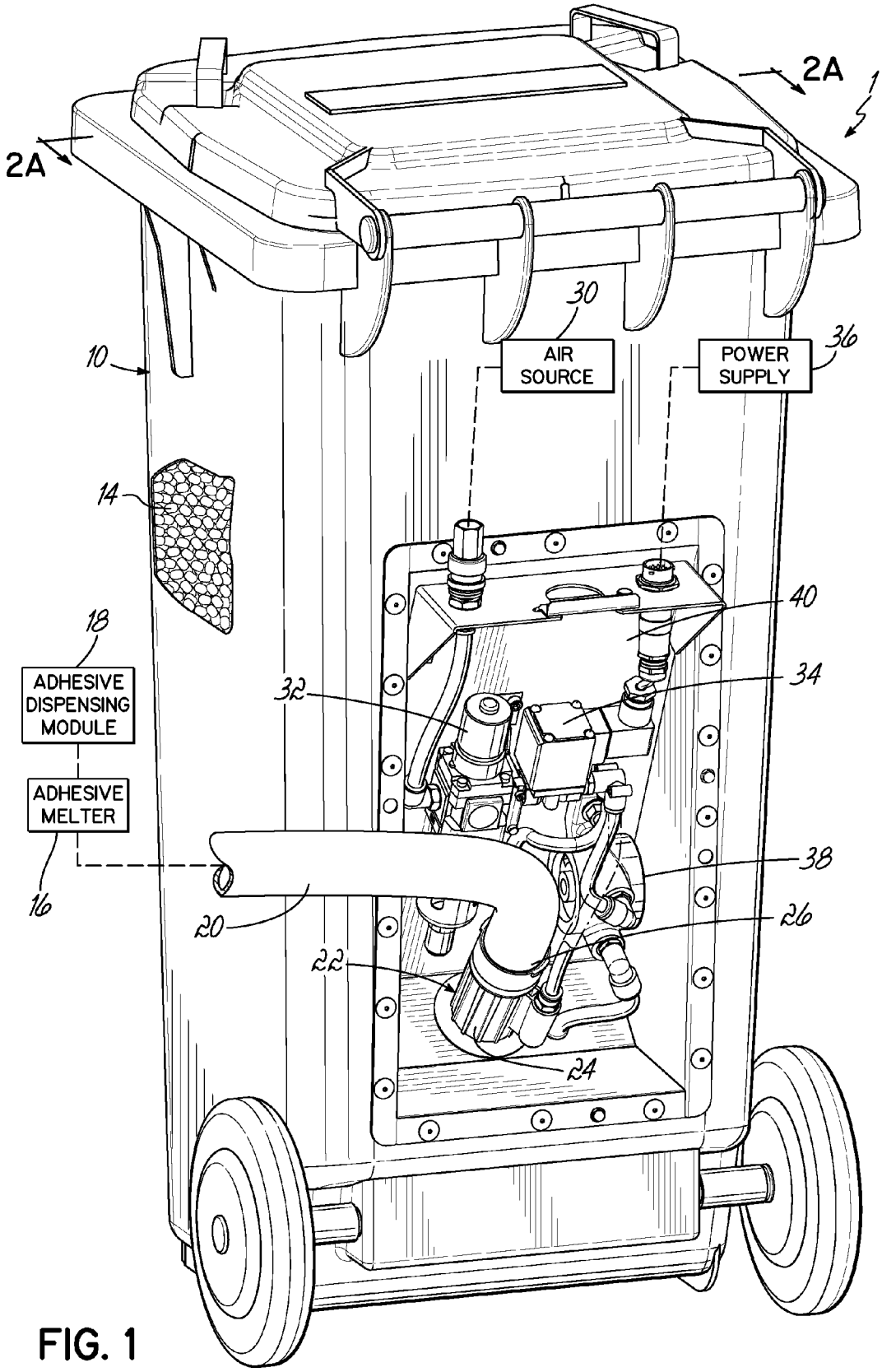
FIG. 1 is a rear perspective view of a hot melt adhesive system, showing details of a supply container and system components mounted on and coupled thereto, including a transfer pump and a transfer hose.

Referring to the figures, and beginning with FIG. 1, an exemplary hot melt adhesive system 1 includes a supply container 10 defining an interior space 12 (see FIG. 2A) that is configured to receive and store a supply of unmelted hot melt adhesive particulate 14, such as adhesive pellets and chips. According to the exemplary embodiment of the system 1, the adhesive particulate is in the form of adhesive pellets. As used herein, the term "adhesive pellets" is not intended to be limiting as to any specific shape or size, so long as the adhesive pellets are suitable to be carried by a stream of forced air. As used herein, the term "air" is meant to encompass any gaseous composition. Furthermore, adhesive pellets may have regular shapes, irregular shapes, or any combination thereof, for example. Additionally, any two pellets may have distinct shapes and/or dimensions and still be jointly and generally referred to as "adhesive pellets."

The collective adhesive particulate 14 stored within the supply container 10 includes a plurality of gaps between individual pieces of adhesive particulate 14. Air is located at least within each of the gaps around the individual pieces of adhesive particulate. The system 1 is configured to transfer adhesive particulate 14 from the supply container 10 to an adhesive melter 16, which in turn is configured to melt the particulate 14 and provide melted, liquid hot melt adhesive (not shown) to, for example, an adhesive dispensing module 18. In particular, a transfer hose 20 communicates with the interior space 12 of the supply container 10 and is configured to transfer adhesive particulate 14 from the supply container 10 to the melter 16. The transfer hose 20 may be of any desired length or diameter suitable to accommodate the adhesive dispensing requirements and the surrounding environment.

Figure 2A:
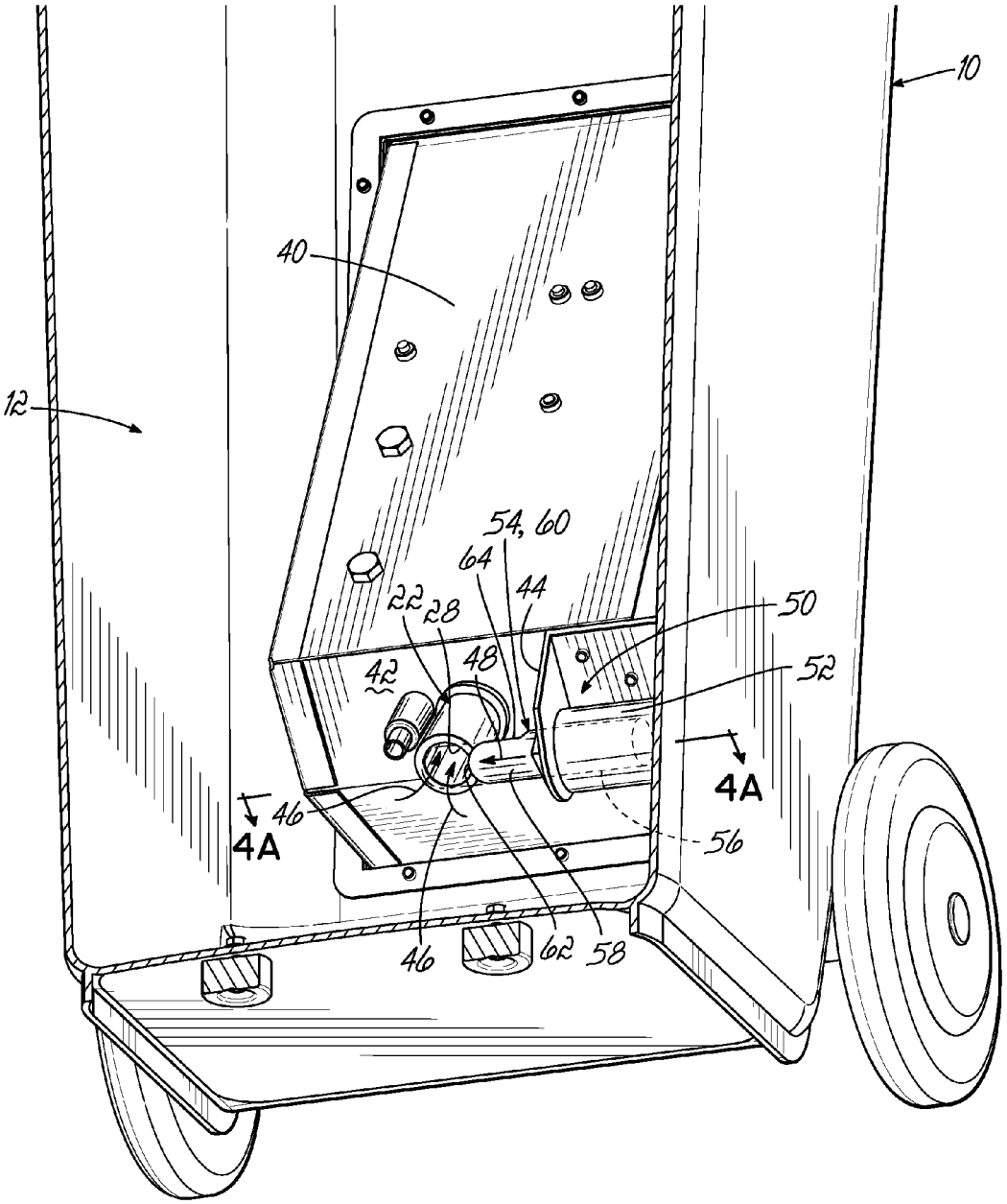
FIG. 2A is a cross-sectional view of the hot melt adhesive system shown in FIG. 1 taken along section line 2A-2A in FIG. 1, showing details of a transfer gate according to an exemplary embodiment of the invention and in a first position.

A transfer pump 22 is operatively connected to the supply container 10 and includes a pump housing 24 that defines a pump outlet 26 and a pump inlet 28 (see FIG. 2A). In an exemplary embodiment, the pump inlet 28 extends into a lower portion of interior space 12 of the supply container 10 such that the pump inlet 28 and interior space 12 fluidly communicate (see FIG. 2A). The transfer pump 22 is operable to generate pumping forces at the pump inlet 28 for withdrawing adhesive particulate 14 and air from the interior space 12 of the supply container 10. In the exemplary embodiment, the transfer pump 22 creates pumping forces in the form of a venturi vacuum and uses an air source 30 providing an air supply (not shown), such as shop air, to create the venturi vacuum. In the exemplary embodiment, the air supplied by the air source 30 first enters an air filter 32 configured to remove impurities from the incoming air supply.

The air withdrawn by the transfer pump 22 from the interior space 12 of the supply container 10 includes the air that is located within the gaps created by the adhesive particulate 14 stored within the container 10, and may further include the air that is located above the stored adhesive particulate 14. For example, as the supply of adhesive particulate 14 depletes, the adhesive particulate 14 drops toward a level that may be below the pump inlet 28 (see FIG. 2A). Consequently, the proportion of the withdrawn air consisting of air located above the adhesive particulate 14 will increase as the transfer pump 22 continues to withdraw adhesive particulate 14.

The pump outlet 26 is operatively coupled to and in fluid communication with the transfer hose 20, such that adhesive particulate 14 and air withdrawn from the container 10 by the transfer pump 22 pass into the transfer hose 20. In the exemplary embodiment, the pump outlet 26 is located exterior to the interior space 12 of the supply container 10.

Still referring to FIG. 1, the exemplary system 1 further includes a controller 34 mounted to a panel 40 that is attached to the supply container 10, the controller 34 being powered by a power supply 36. The controller 34 receives air supplied by the air source 30, after the air passes through the air filter 32, and is configured to operatively direct the air to various components of the system 1. In the exemplary embodiment, the controller 34 directs air to the transfer pump 22 for creation of the venturi vacuum used to withdraw the adhesive particulate 14 from the supply container 10. The controller 34 also directs air to a pneumatically operated vibrator 38. The vibrator 38 vibrates the supply container 10 for reducing compaction of the stored adhesive particulate 14 and assisting the withdrawal of adhesive particulate 14.

Figure 2B:
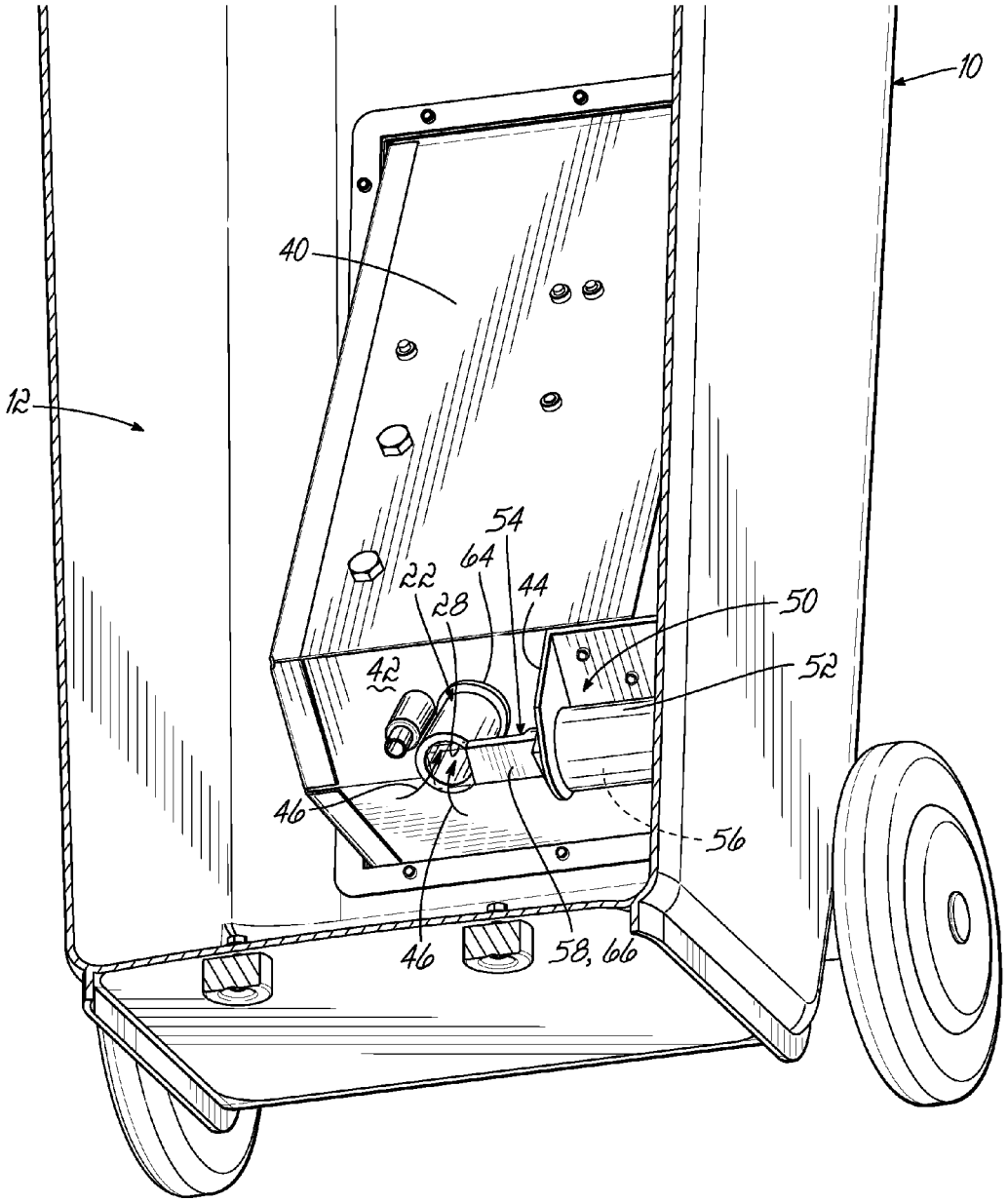
FIG. 2B is a cross-sectional view similar to FIG. 2A, but showing details of a transfer gate according to another exemplary embodiment of the invention and in a first position.

Referring now to FIGS. 2A and 2B, an exemplary embodiment of the system 1 includes a transfer gate 50 having an actuator 52 and a blocking member 54 coupled thereto such that the blocking member 54 is movable by the actuator between a first, retracted position and a second, extended position, as explained in greater detail below. The transfer gate 50 is positioned proximate the pump inlet 28 and is mounted to an interior surface 42 of panel 40 by any suitable means, such as bracket 44. In alternative embodiments (not shown), the actuator 52 and/or the blocking member 54 may be positioned at various locations exterior to the interior space 12 of the supply container 10. For example, the entire transfer gate 50 assembly may be positioned proximate the pump outlet 26 or at any preferred location downstream of the pump outlet 26. As used herein, the term "downstream" references the directional flow of adhesive particulate and air from the supply container 10 toward the adhesive melter 16. For example, the adhesive melter 16 is downstream of the transfer hose 20.

The blocking member 54 includes a proximal portion 56 movably coupled to the actuator 52, and a distal portion 58 extending from the proximal portion 56. The distal portion 58 is configured to block the transfer of adhesive particulate 14 through the transfer hose 20 when the blocking member 54 is moved to the extended position. For example, as shown in the embodiments in FIGS. 2A and 2B, the distal portion 58 is configured to at least partially overlie and at least partially obstruct the pump inlet 28 in the extended position in order to block adhesive particulate from being withdrawn through the pump inlet 28.

In exemplary embodiments shown in FIGS. 2A, 3A, and 4A-5B, the blocking member 54 is preferably a rod 60 in which the distal portion 58 has a smaller cross sectional area than the proximal portion 56. More preferably, the proximal portion 56 of rod 60 has a generally circular cross section that tapers into a generally semi-circular cross section of distal portion 58, which then terminates in a rounded tip 62. As shown, this taper is such that the cross sections of the proximal portion 56 and the distal portion 58 have equal radii. Accordingly, the distal portion 58 of the rod 60 includes a planar surface 64 that cooperates with the pump inlet 28 in the extended position. Specifically, the planar surface 64 is adjacent to and faces the pump inlet 28 such that the planar surface 64 spans across a majority of the diameter of the pump inlet 28 in the extended position. The features of rod 60 described above advantageously facilitate the movement of the rod 60 past adhesive particulate 14 compacted in the regions surrounding the rod 60, while still providing adequate obstruction of the pump inlet 28 in the extended position. In turn, this reduces an actuation force that the actuator 52 must exert on the rod 60 in order to effectively move the rod 60 from a retracted position to an extended position.

In an alternative embodiment shown in FIG. 2B, at least the distal portion 58 of blocking member 54 is in the form of a plate 66. The plate 66 may be of any suitable shape and may be perforated (not shown) so as to allow air to freely flow through the plate 66. The blocking member 54 is made of any suitable material, such as an aluminum alloy, plastic, or fiber-reinforced composite, for example.

The blocking member 54 is movable by actuator 52 between a first, retracted position (shown in FIGS. 2A, 2B, 4A, and 5A) and a second, extended position (shown in FIGS. 3A, 3B, 4B, and 5B). With the blocking member 54 in the retracted position, the stored adhesive particulate 14 and air are permitted to be withdrawn from the supply container 10 through the pump inlet 28 so that they may be passed into the transfer hose 20 (see FIG. 1). This withdrawal of adhesive particulate 14 is indicated by arrows 46 in FIGS. 2A and 2B. When the blocking member 54 is actuated to the extended position (indicated in FIG. 2A by actuation arrow 48 and phantom lines), the distal portion 58 of blocking member 54 overlies and substantially obstructs the pump inlet 28 such that the adhesive particulate 14 is blocked from being withdrawn through the pump inlet 28, while air is still permitted to be withdrawn into the transfer hose 20 and toward the adhesive melter 16. As a result of actuating the blocking member 54 to the extended position while the transfer pump 22 is still operating to force air through the transfer hose 20, the transfer hose 20 is flushed of residual adhesive particulate 14 therein. Ideally, all adhesive particulate 14 is removed from the hose 20 during this process, however, it will be understood that removing less than all remaining adhesive particulate 14 will still be beneficial and within the scope of the invention. At the same time, additional adhesive particulate 14 is prevented from exiting the supply container 10. Periodic flushing of the transfer hose 20 in this manner helps to prevent clogging and thereby increase the operating efficiency of the system 1. For example, this may be done at the end of each particulate fill cycle for the melter 16.

Persons skilled in the art will appreciate that in alternative embodiments where the transfer gate 50 is positioned at a location exterior to the interior space 12 of the supply container 10, the blocking action performed by blocking member 54 in the extended position will occur at a location downstream of the pump inlet 28. For example, where the transfer gate 50 is positioned downstream of the pump outlet 26, the blocking member 54 in the extended position will permit adhesive particulate 14 to be withdrawn from the supply container 10 through the transfer pump 22 and into an upstream portion of a particulate transfer conduit or other structure. Upon reaching the blocking member 54 in the extended position, the withdrawn particulate 14 will be blocked from passing further downstream toward the melter 16 and the remainder of the transfer structure will be flushed of residual particulate 14.

Figure 3A:
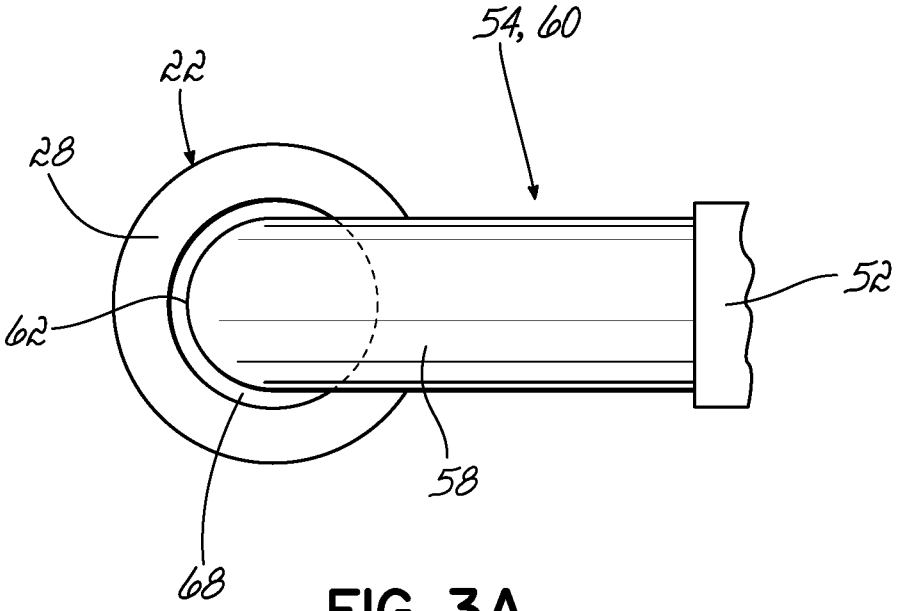
FIG. 3A is an enlarged elevational view of the transfer gate of FIG. 2A in a second position.

Referring to FIG. 3A, an exemplary blocking member 54 in the form of rod 60 is shown in the extended position in which the distal portion 58 overlies and substantially obstructs the pump inlet 28. A gap 68 is thereby formed between the distal portion 58 and pump inlet 28. The gap 68 is preferably sized such that it is small enough to block generally the smallest piece of adhesive particulate 14 from being withdrawn through the pump inlet 28, yet large enough to permit sufficient withdrawal of air for effective flushing of the transfer hose 20.

Figure 3B:
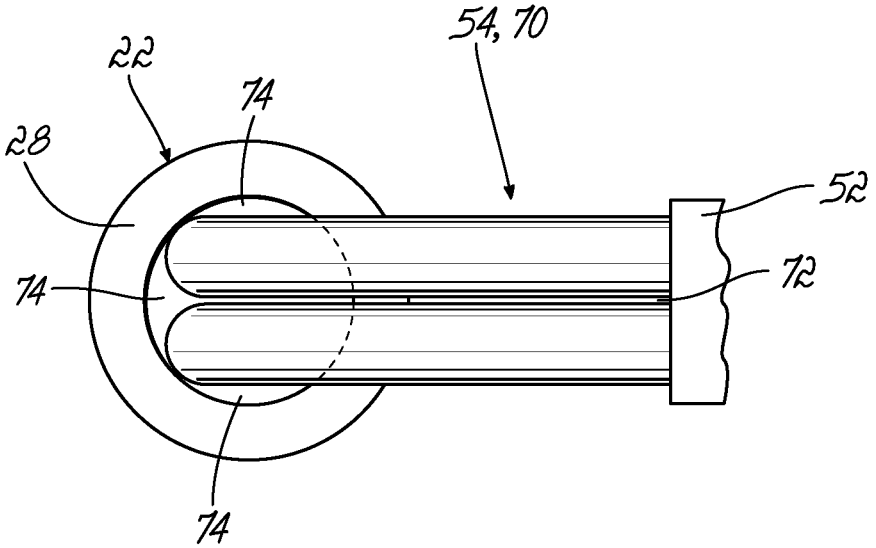
FIG. 3B is an enlarged elevational view similar to FIG. 3A, but showing a transfer gate according to another exemplary embodiment of the invention in a second position.

Referring to FIG. 3B, an alternative embodiment of the invention is shown in which the blocking member 54 is a plurality of rods 70. A central gap 72 is defined between each pair of the plurality of rods 70. In the extended position, the plurality of rods 70 overlie the pump inlet 28 and thereby form a plurality of gaps 74 similar to the gap 68 formed by rod 60 in the extended position. Accordingly, the gaps 72, 74 are each preferably sized to be small enough to block generally the smallest piece of adhesive particulate 14 from being withdrawn through the pump inlet 28, yet large enough to permit sufficient withdrawal of air for effective flushing of the transfer hose 20.

Figure 4A:
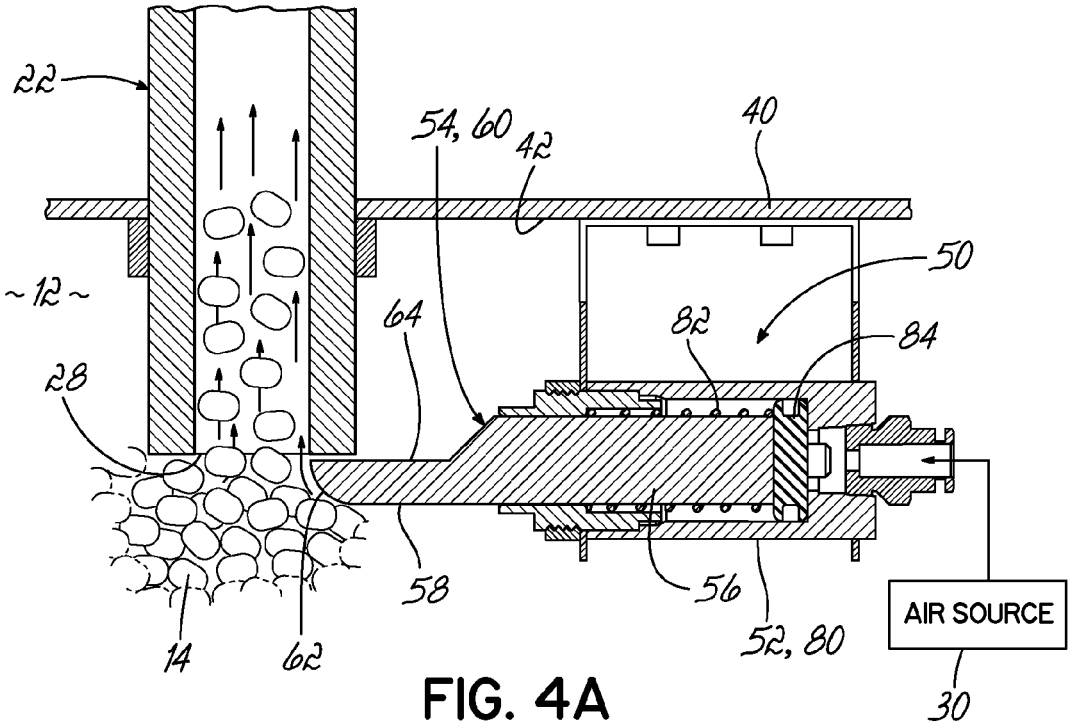
FIG. 4A is a cross-sectional view of the transfer gate of FIG. 2A according to an exemplary embodiment of the invention, taken along line 4A-4A in FIG. 2A, showing the transfer gate in a first position.
Figure 4B:
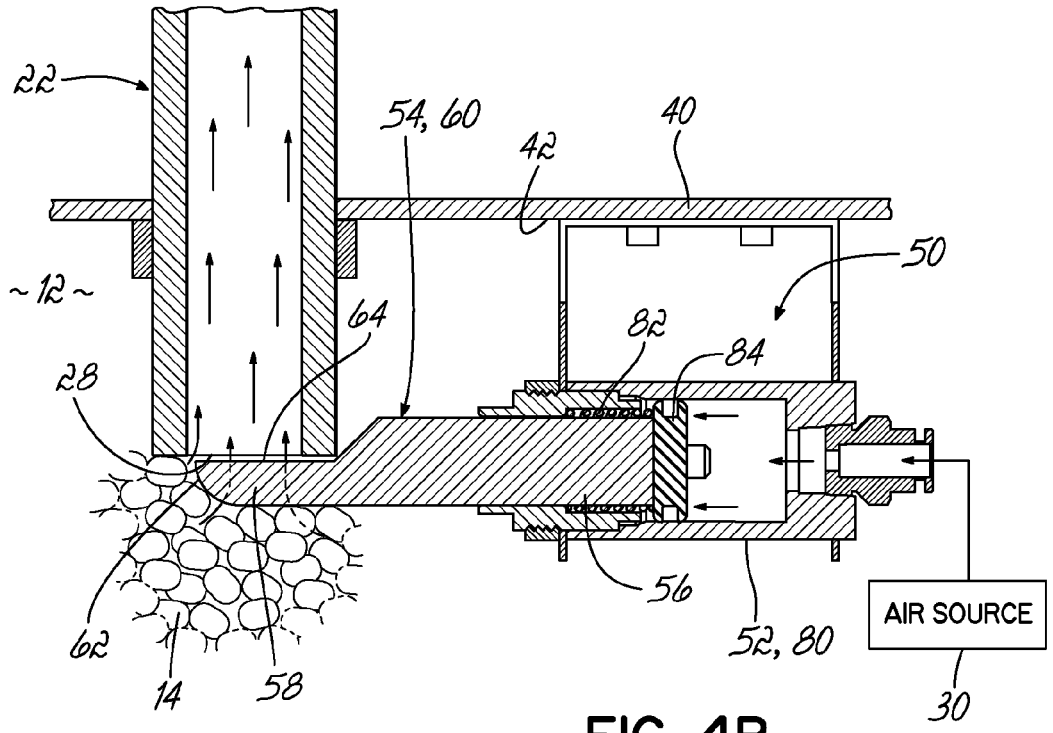
FIG. 4B is a cross-sectional view similar to FIG. 4A, but showing the transfer gate in a second position.

Referring to FIGS. 4A and 4B, an exemplary embodiment of the invention is shown in which the actuator 52 is a pneumatic cylinder 80 and the blocking member 54 is the rod 60 as described above. This embodiment of the invention includes a compression spring 82 that overwraps the proximal portion 56 of the rod 60 and is retained by an inner surface of the cylinder 80 at one end and by a ring member 84 attached to the proximal portion 56 at the other end. The spring 82 biases the rod 60 toward the retracted position. The cylinder 80 is activated by an air source, which may be the air source 30 used by the transfer pump 22 to create pumping forces at the pump inlet 28. FIG. 4A shows the pneumatic cylinder 80 in an inactive state, wherein rod 60 is in the retracted position such that the stored adhesive particulate 14 and air in interior space 12 are permitted to be withdrawn through pump inlet 28. FIG. 4B shows the pneumatic cylinder 80 in an active state, achieved by forcing air into the cylinder 80. The pressure of the air source applied to the cylinder 80 may be adjusted to extend the rod 60 outwardly with a force sufficient for passing through the adhesive particulate 14 in the region surrounding the distal portion 58 and the pump inlet 28. The rod 60 is pushed outwardly toward the extended position such that the stored adhesive particulate 14 is blocked by distal portion 58 from being withdrawn through the pump inlet 28, while air is still permitted to be withdrawn to thereby flush the transfer hose 20 of residual adhesive particulate therein. In this active state, spring 82 is flexed and biases the rod 60 toward the retracted position. The pneumatic cylinder 80 is deactivated by interrupting the air source, at which point the rod 60 snaps back to the retracted position under a spring force exerted by the spring 82. Persons of ordinary skill in the art will appreciate that spring 82 may be substituted with any other suitable resilient means to bias the rod 60 toward a retracted position.

Figure 5A:
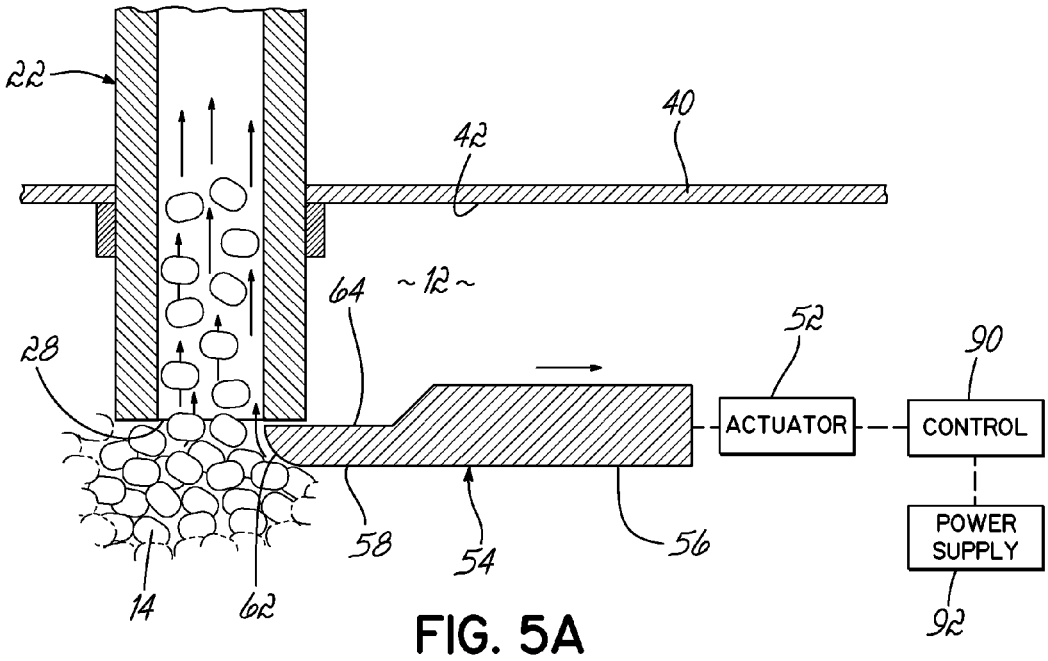
FIG. 5A is a cross-sectional schematic view of the transfer gate of FIG. 2A, showing the transfer gate in a first position and illustrating a more general actuating system.
Figure 5B:
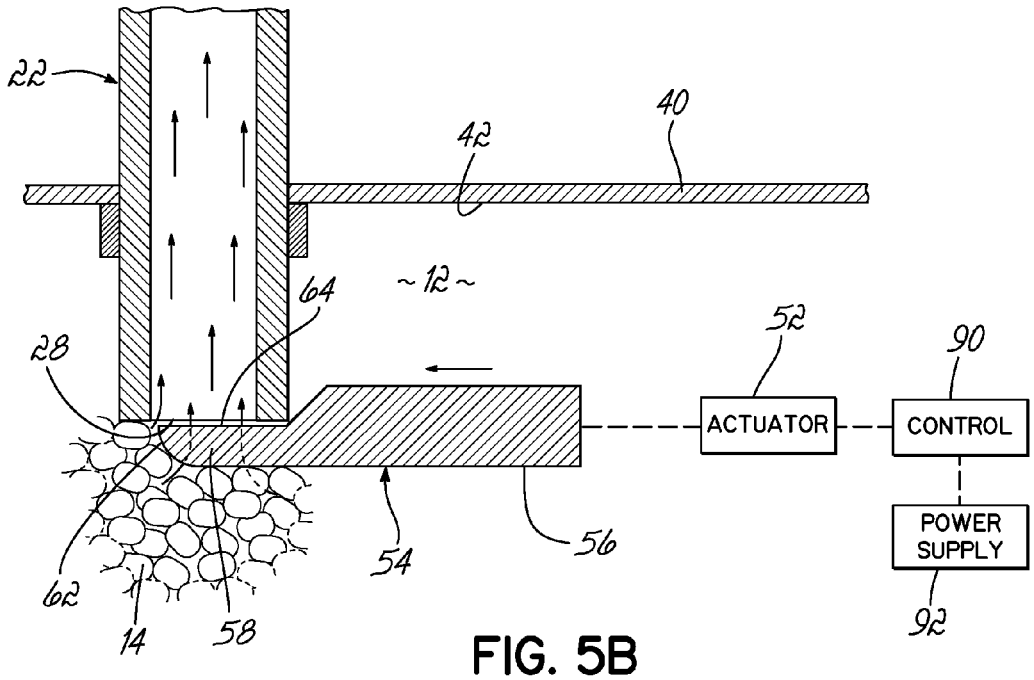
FIG. 5B is a cross-sectional schematic view similar to FIG. 5A, but showing the transfer gate in a second position.

Referring to FIGS. 5A and 5B, various alternative embodiments of the invention are represented by the schematic depiction of the actuator 52, which may be controlled by any suitable control device 90 and powered by any suitable power supply 92. Whereas the actuator 52 is preferably powered by an air source, as embodied by the pneumatic cylinder 80 described above, the actuator 52 may alternatively be powered by an electrical source. For example, the actuator 52 may be a linear solenoid, a stepper motor, or similar devices, each including appropriate structure for coupling to a blocking member 54. Accordingly, persons of ordinary skill in the art will appreciate that the actuator 52, as depicted in FIGS. 5A and 5B, may include any pneumatically or electrically powered device capable of moving the blocking member 54, such as rod 60, between a retracted position and an extended position as described herein.

In another alternative embodiment of the invention (not shown), the actuator 52 is substituted with any suitable structure permitting the blocking member 54 to be moved manually between the retracted and extended positions. For example, a lever arm may be coupled at one end to the proximal portion 56 of rod 60 and extend outwardly through an aperture in the container 10 to form a handle, such that an operator may grip and exert a force on the handle to move the rod 60 between the retracted and extended positions.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A hot melt adhesive system, comprising:

a supply container for storing adhesive particulate;

a transfer pump operatively connected to the supply container, the transfer pump including a pump inlet and a pump outlet, the transfer pump being configured to generate a vacuum at the pump inlet to thereby withdraw the stored adhesive particulate and air into the pump inlet from the supply container;

a transfer hose operatively coupled to the pump outlet for transferring the withdrawn adhesive particulate toward an adhesive melter; and a blocking member, the blocking member being movable between a first position in which the stored adhesive particulate and air are permitted to be withdrawn from the supply container into the transfer hose and a second position in which the stored adhesive particulate is blocked from passing through the transfer hose while air is permitted to pass by the blocking member and through the transfer hose toward the adhesive melter to thereby flush the transfer hose of residual adhesive particulate therein.

2. The hot melt adhesive system of claim 1, wherein the blocking member is disposed proximate the pump inlet and is configured to at least partially overlie and at least partially obstruct the pump inlet in the second position.

3. The hot melt adhesive system of claim 2, wherein the pump inlet extends into an interior space of the supply container.

4. The hot melt adhesive system of claim 2, wherein the blocking member includes a proximal portion and a distal portion extending therefrom, the distal portion having a smaller cross sectional area than the proximal portion in order to facilitate movement of the blocking member through the adhesive particulate from the first position to the second position.

5. The hot melt adhesive system of claim 4, wherein the proximal portion tapers into the distal portion and the distal portion includes a planar surface configured to cooperate with the pump inlet and lie adjacent thereto when the blocking member is in the second position.

6. The hot melt adhesive system of claim 4, wherein the distal portion terminates in a rounded end in order to further facilitate movement of the blocking member through the adhesive particulate from the first position to the second position.

7. The hot melt adhesive system of claim 1, wherein the blocking member includes at least one rod.

8. The hot melt adhesive system of claim 1, wherein the blocking member includes a plate.

9. The hot melt adhesive system of claim 1, further comprising an actuator coupled with the blocking member, the blocking member being movable by the actuator between the first position and second position.

10. The hot melt adhesive system of claim 9, wherein the actuator is powered by an air source.

11. The hot melt adhesive system of claim 10, wherein the actuator includes a pneumatic cylinder.

12. The hot melt adhesive system of claim 9, wherein the actuator is powered by an electrical source.

13. The hot melt adhesive system of claim 12, wherein the actuator includes a linear solenoid.

14. The hot melt adhesive system of claim 12, wherein the actuator includes a stepper motor.

15. The hot melt adhesive system of claim 1 further comprising the adhesive melter operatively coupled to the transfer hose for receiving and melting the adhesive particulate.

16. A method of operating a hot melt adhesive system including a supply container for storing adhesive particulate, a transfer pump operatively connected to the supply container and having a pump inlet and a pump outlet, a transfer hose operatively coupled to the pump outlet, and a blocking member, the method comprising:

placing the blocking member in a first position in which the stored adhesive particulate and air are permitted to be withdrawn from the supply container into the transfer hose;

powering the transfer pump to generate a vacuum at the pump inlet to thereby withdraw the stored adhesive particulate and air into the pump inlet from the supply container and into the transfer hose;

transferring the withdrawn adhesive particulate through the transfer hose toward an adhesive melter;

moving the blocking member to a second position in which the stored adhesive particulate is blocked from passing through the transfer hose while air is permitted to pass by the blocking member and through the transfer hose toward the adhesive melter; and withdrawing additional air from the supply container past the blocking member in the second position to thereby flush the transfer hose of residual adhesive particulate therein.

17. The method of claim 16, wherein moving the blocking member to the second position further comprises:

at least partially obstructing the pump inlet.

18. The method of claim 17, wherein moving the blocking member to the second position further comprises:

forming a gap between the blocking member and the pump inlet, the gap being sized to permit airflow therethrough and to block adhesive particulate from passing through the transfer hose.

19. The method of claim 16, wherein moving the blocking member to the second position further comprises:

moving a rod having a proximal portion and a distal portion extending therefrom, the distal portion having a smaller cross sectional area than the proximal portion in order to facilitate moving the rod through the adhesive particulate toward the second position.

20. The method of claim 16, wherein the hot melt adhesive system further includes an actuator coupled with the blocking member, and moving the blocking member to the second position further comprises:

moving the blocking member with the actuator.

21. The method of claim 16, wherein transferring the withdrawn adhesive particulate further comprises:

placing adhesive particulate in the adhesive melter.

* * * * *